US006500283B1

(12) United States Patent
Schaeffer et al.

(10) Patent No.: US 6,500,283 B1
(45) Date of Patent: Dec. 31, 2002

(54) METHOD OF IMPROVING ENVIRONMENTAL RESISTANCE OF INVESTMENT CAST SUPERALLOY ARTICLES

(75) Inventors: Jon C. Schaeffer, Milford, OH (US); Wendy H. Murphy, Cincinnati, OH (US); Norman R. Lindblad, Cincinnati, OH (US)

(73) Assignee: General Electric Company, Schenectady, NY (US)

( * ) Notice: Subject to any disclaimer, the term of this patent is extended or adjusted under 35 U.S.C. 154(b) by 1265 days.

(21) Appl. No.: 08/946,017

(22) Filed: Oct. 7, 1997

Related U.S. Application Data

(63) Continuation of application No. 08/570,741, filed on Dec. 12, 1995, now abandoned.

(51) Int. Cl.[7] ..... C22F 1/10

(52) U.S. Cl. ..... 148/522; 148/538; 148/548; 148/555; 148/675; 164/66.1; 164/69.1; 164/122.2

(58) Field of Search ..... 164/76.1, 66.1, 164/138, 516, 524, 122.1, 122.2, 69.1, 70.1; 148/555, 538, 556, 675, 548, 27, 28, 522; 216/55, 95, 108, 109; 134/3, 5; 29/527.3, 527.2, 527.6, 889.21, 889.22, 889.71

(56) References Cited

U.S. PATENT DOCUMENTS

| | | | | | |
|---|---|---|---|---|---|
| 3,494,709 | A | * | 2/1970 | Piearcey | 148/404 |
| 3,598,170 | A | * | 8/1971 | Roberts | 420/448 |
| 3,643,728 | A | * | 2/1972 | Hulse | 164/138 |
| 3,891,425 | A | * | 6/1975 | McCarty | 148/27 |
| 3,933,190 | A | * | 1/1976 | Fassler et al. | 164/41 |
| 4,049,470 | A | | 9/1977 | Burton | |
| 4,093,017 | A | * | 6/1978 | Miller et al. | 164/138 |
| 4,240,828 | A | * | 12/1980 | Huseby | 164/138 |
| 4,244,551 | A | * | 1/1981 | Terkelsen et al. | 164/41 |
| 4,437,913 | A | * | 3/1984 | Fukui et al. | 148/404 |
| 4,512,817 | A | | 4/1985 | Duhl et al. | |
| 4,703,806 | A | | 11/1987 | Lassow et al. | 164/518 |
| 4,729,787 | A | * | 3/1988 | Ototani et al. | 75/564 |
| 4,787,439 | A | | 11/1988 | Feagin | 164/518 |
| 4,810,312 | A | | 3/1989 | Allen | |
| 4,814,024 | A | | 3/1989 | Heetfield | |
| 5,100,484 | A | * | 3/1992 | Wukusick et al. | 148/404 |
| 5,221,336 | A | * | 6/1993 | Horton | 164/518 |
| 5,335,717 | A | | 8/1994 | Chin et al. | 164/519 |
| 5,346,563 | A | * | 9/1994 | Allen et al. | 148/675 |
| 5,407,001 | A | | 4/1995 | Yasrebi et al. | 164/519 |
| 5,538,796 | A | * | 7/1996 | Schaffer et al. | 148/675 |

OTHER PUBLICATIONS

ASM Handbook, vol. 15, "Investment Casting" pp 253–269, 9/88.*

* cited by examiner

*Primary Examiner*—George Wyszomierski
(74) *Attorney, Agent, or Firm*—David L. Narciso; Gary M. Hartman; Domenica N. S. Hartman

(57) ABSTRACT

A method for promoting the environmental resistance of nickel, iron and cobalt-base superalloys of the type alloyed to develop a protective oxide scale. The method entails a technique for removing sulfur during or subsequent to the casting operation. The method generally includes casting a superalloy article in a mold cavity, and then heat treating the article while surfaces of the article are in contact with a compound containing a sulfide and/or oxysulfide-forming element, such as yttria, calcium oxide, magnesia, scandia, ceria, hafnia, zirconia, titania, lanthana, alumina and/or silica. The heat treatment is performed at a temperature sufficient to cause sulfur within the superalloy article to segregate to the surfaces of the article and react with the sulfide-forming element, thereby forming sulfides at the interface with the compound. The compound is then removed from the surfaces of the article so as to simultaneously remove the sulfides and any elemental sulfur that have segregated to the surface of the article.

11 Claims, 2 Drawing Sheets

METHOD OF IMPROVING ENVIRONMENTAL RESISTANCE OF INVESTMENT CAST SUPERALLOY ARTICLES

This application is a Continuation of application Ser. No. 08/570,741 filed Dec. 12, 1995, now abandoned.

This invention relates to methods for casting superalloy articles. More particularly, this invention is directed to a method for processing an article cast from an oxide scale-forming superalloy, in which the sulfur content of the superalloy is reduced so as to result in the article exhibiting improved environmental resistance.

BACKGROUND OF THE INVENTION

Higher operating temperatures of gas turbine engines are continuously sought in order to increase their efficiency. However, as operating temperatures increase, the high temperature durability of the components of the engine must correspondingly increase, particularly those engine components subjected to the most severe thermal environments, including the first and second stage high pressure turbine airfoils, first and second stage nozzles, and shrouds. Significant advances in high temperature capabilities have been achieved through the formulation of nickel, iron and cobalt-base superalloys whose mechanical properties at elevated temperatures are enhanced when produced in the form of a single crystal or directionally solidified casting. Even so, such advanced superalloys alone are often inadequate for components to survive the severe thermal and oxidizing environment in the turbine, combustor and augmentor sections of a gas turbine engine.

A common solution is to form a protective layer on such components in order to minimize their service temperatures and enhance their environmental performance. For this purpose, superalloys have been formulated to develop a metal oxide surface scale that forms a stable and environmentally-resistant barrier layer on the surface of the superalloy. In addition, thermal barrier coatings (TBC) of ceramic materials have also been developed that tenaciously adhere to the oxide layer on the surfaces of the superalloy. To be effective, such protective layers and coatings must be strongly adherent to the component and remain adherent through many heating and cooling cycles. This requirement is particular demanding due to the different coefficients of thermal expansion between the oxides and ceramic materials that form the protective layer and the superalloy materials that form the turbine engine components.

Though advances have been made, a continuing challenge has been to achieve more adherent oxide layers and thermal barrier coatings that are less susceptible to spalling. It is known that spallation is encouraged by the presence of sulfur within a superalloy. When the superalloy is heated, the sulfur segregates to the critical oxide-metal interface and weakens the chemical bond strength of the interface, thereby permitting spallation of the oxide layer and the thermal barrier coating (if present) and depleting the superalloy of critical scale-forming elements such as aluminum and chromium. Therefore, efforts have been made to either reduce the sulfur content of superalloys or prevent sulfur from segregating to the oxide-metal interface. Such efforts have included adding an oxygen-active element such as yttrium to the superalloy composition, thereby forming a stable sulfide that remains dispersed in the bulk alloy. Alternatively, the amount of sulfur in a superalloy composition can be held to levels that are sufficiently low, generally about one part per million by weight (ppmw) or less, to avoid the deleterious effect of sulfur segregation to the oxide-metal interface.

Methods for achieving low levels of sulfur in a superalloy are typically characterized as expensive or ill-suited for mass-produced superalloy components,;such as airfoils, nozzles and shrouds. For example, though hydrogen annealing techniques have been shown to reduce sulfur content to as little as 0.2 ppmw, such techniques require long anneals at high temperatures in a reducing environment that poses a significant hazard. Alloy processing techniques by which sulfur is reacted with rare earth metals have proven to be feasible, but additional reactions occur that permit sulfur to be reintroduced into the metal.

In contrast to the above, methods by which yttrium is added to cast superalloy components are relatively developed. Yttrium is typically chosen over other oxygen-active elements because of its solubility, higher relative eutectic temperature with nickel, and lower relative cost. Yttrium is typically added in an amount that is larger than that required to tie up the sulfur within the superalloy because some yttrium is lost to evaporation, while the remaining yttrium tends to react with the ceramic molds and cores used in the casting operation. An example of the latter is the reaction of yttrium with silica-containing molds and cores widely used to investment cast superalloy components:

$$3O_2+3SiO_2+2Y \rightarrow Y_2(SiO_4)_3$$

To prevent the removal of yttrium through such a reaction, facecoats for ceramic molds and cores have been developed that are nonreactive with yttrium in the superalloy melt. Facecoats formed of yttria ($Y_2O_3$) are widely employed since they contain yttrium in its most stable state, though other very stable oxide compounds could be used as facecoat materials.

Though the use of such facecoats enables sufficient yttrium to remain in the superalloy melt and bind the sulfur within the melt, the relatively high levels of yttrium required are not always desirable in terms of the desired properties for the superalloy. Accordingly, it would be desirable if other methods were available that prevented the deleterious effect of sulfur segregation at the oxide-metal interface of a superalloy article and were conducive to mass-produced superalloy components, yet avoided the requirement for high levels of rare earth metals within the superalloy composition.

SUMMARY OF THE INVENTION

It is an object of this invention to provide a method for forming a superalloy article on which a protective oxide scale is developed to promote the environmental resistance of the article.

It is a further object of this invention that such a method entails processing steps that prevent spallation of the oxide scale caused by the segregation of sulfur to the interface between the oxide scale and metal substrate.

It is still a further object of this invention that such a method eliminates the requirement to include relatively high levels of oxygen-active elements in the superalloy for the purpose of tying up sulfur and preventing its segregation to the oxide-metal interface.

It is yet another object of this invention that such a method does not require long processing times, such that the method is conducive to high volume production.

The present invention provides a method for promoting the environmental resistance of articles cast from nickel, iron and cobalt-base superalloys of the type alloyed to develop a protective oxide scale, including various alloys used in the production of high pressure turbine airfoils, nozzles and shrouds. The method entails removing sulfur during or subsequent to the casting operation, and therefore does not rely on techniques that remove sulfur from the superalloy melt or require high levels of an oxygen-active element within the superalloy.

The method generally includes casting a superalloy article in a mold cavity, and then heat treating the article while the surfaces of the article are in contact with a compound containing a sulfide-forming element. As used herein, sulfides encompass sulfides, oxysulfides and other sulfide compounds that may form as a reaction product of sulfur in the article. The heat treatment is performed at a temperature sufficient to cause sulfur within the superalloy article to segregate to the surfaces of the article, which enables the sulfur to react with the sulfide-forming element and thereby form sulfides at the surface of the compound. The compound is then separated from the surfaces of the article so as to simultaneously remove the sulfides and any elemental sulfur that have segregated to the surface of the article. Advantageously, because sulfur is removed with the compound, additional processing or surface treatments of the article for sulfur removal are unnecessary.

In one embodiment of the invention, the surfaces of the mold cavity are coated with the compound containing the sulfide-forming element, and the heat treatment is carried out while the article is within the mold cavity. In this manner, separation of the compound entails removing the article from the mold cavity, during which sulfides and elemental sulfur at the surface of the article are simultaneously removed. In another embodiment of this invention, the compound containing the sulfide-forming element is deposited as a coating on the article after the article has been removed from the mold cavity and prior to the heat treating step. After heat treatment, the compound is removed from the surfaces of the article by a chemical or mechanical process.

According to this invention, one or more compounds containing a sulfide-forming element can be used in combination, examples of which include yttria ($Y_2O_3$), calcium oxide (CaO), magnesia (MgO), scandia ($Sc_2O_3$), ceria ($CeO_2$), hafnia ($HfO_2$), zirconia ($ZrO_2$), titania ($TiO_2$) lanthana ($La_2O_3$), alumina ($Al_2O_3$) and silica ($SiO_2$). In addition, heat treatments can be performed subsequent to removal of the sulfides, as may be desired to stress relieve, age or otherwise improve the mechanical properties of the superalloy article.

The method of this invention results in a superalloy article characterized by enhanced environmental resistance as a result of sulfur being removed during the manufacture of the article. Specifically, the oxide scale and any thermal barrier coating employed to form a protective barrier on the surface of the article are less susceptible to spalling as a result of sulfur segregation being prevented. Advantageously, the method does not require long processing times or special fixtures, additional alloying constituents that might alter the properties of the superalloy, or materials that are expensive or difficult to obtain. As a result, the method is highly conducive to use in the manufacture of relatively high volume components, such as airfoils, nozzles and shrouds of gas turbine engines.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE INVENTION

Investment cast components for high temperature regions of a gas turbine engine are typically formed from a nickel, iron and cobalt-base superalloy containing aluminum and chromium, which enable the superalloy to form a protective oxide surface scale that promotes the ability of the component to survive its harsh thermal and oxidizing environment. The deleterious effect that sulfur has on this oxide scale is prevented by this invention through removal of sulfur during processing of the superalloy component. Specifically, it has been unexpectedly determined that sulfur within a superalloy will react with and can be removed with an yttrium-containing mold, facecoat or coating if a high temperature heat treatment is performed in a vacuum or nonreactive atmosphere while the surface of the superalloy is in contact with the mold, facecoat or coating. According to this invention, the heat treatment enables sulfur to be removed from the surface of the superalloy in the form of sulfides, which as used herein include oxysulfides and other sulfide compounds, though elemental sulfur can also be removed from the surface of the superalloy.

While the following discussion will focus primarily on the use of yttria as a facecoat or coating material, it is within the scope of this invention that other compounds, alone or in combination, containing a sulfide-forming element could be used. Such compounds include calcium oxide, magnesia, scandia, ceria, hafnia, zirconia, titania, lanthana, alumina and silica. It is also within the scope of this invention to provide the compound containing the sulfide-forming element in any form capable of achieving surface-to-surface contact between the superalloy and the compound. As such, the invention is not necessarily limited to molds, facecoats and coatings formed to include compounds containing a sulfide-forming element, in that such compounds could foreseeably be provided in various other forms.

The method of this invention can be carried out with procedures that differ as to when sulfur is removed from the component, though all share the common technique of removing sulfur after the superalloy has been poured into a mold from which the component is formed. As such, any subsequent processing of the superalloy will be as a cast component, such that the likelihood of sulfur being reintroduced into the superalloy is substantially reduced.

Figure 1:
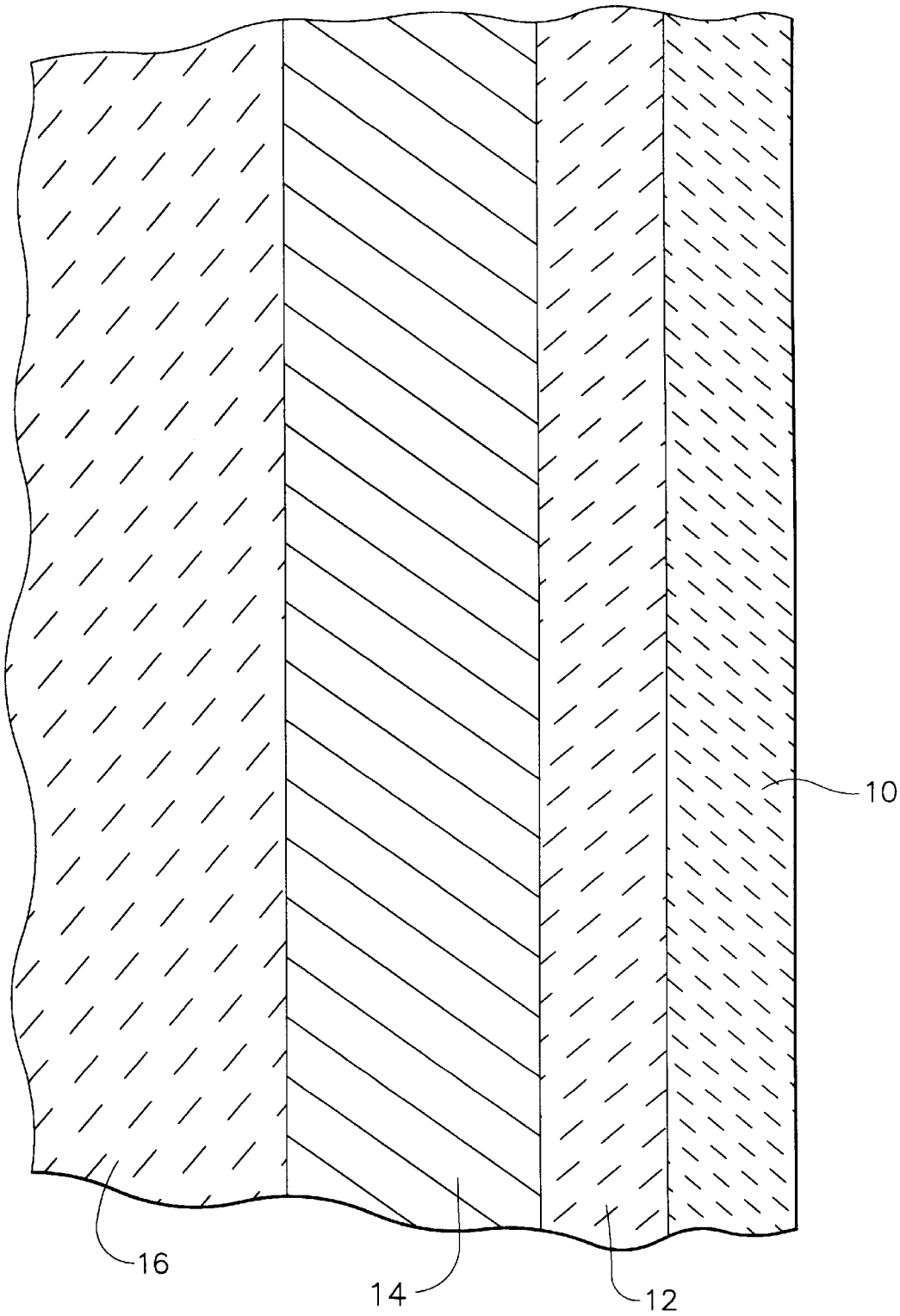
FIG. 1 is a schematic cross-sectional view of mold assembly in which a superalloy article has been cast in accordance with one embodiment of this invention.

A first embodiment of this invention is represented in FIG. 1, which depicts a ceramic shell mold 10, a ceramic facecoat 12 ovelaying the surface of the mold 10, a wall of a superalloy component 14 that has been cast within the mold 10, and a ceramic mold core 16 employed in a conventional manner to form an interior surface of the component 14. According to this invention, the superalloy melt may include typical impurity levels of sulfur, such as on the order of about 10 ppmw or more. As indicated, the superalloy component 14 has been cast within the mold 10 on whose surface is provided the facecoat 12 of yttria. Additionally, the surfaces of the mold core 16 also have a facecoat or coating of yttria. The thickness of the facecoat 12 may vary, though a thickness of at least about 0.3 millimeter, more preferably at least about one millimeter, is believed to be appropriate to ensure a continuous layer that can effectively react with and remove any sulfur that subsequently segregates to the surface of the component 14 during the prescribed heat treatment.

Once poured into the mold 10, the alloy melt is cooled at a rate effective to yield a desired microstructure for the component 14, including a directionally solidified or single crystal microstructure. Thereafter, and with all surfaces of the component 14 remaining in contact with the facecoat 12 and core 16, the entire mold assembly is heated at a temperature sufficient to cause sulfur within the component 14 to segregate to the surface of the component 14. In practice, it has been found that a preferred heat treatment is a solution treatment performed at the solution temperature of the superalloy, generally below its solidus temperature. The atmosphere for the heat treatment can be either a vacuum, an atmosphere containing a hydrogen mixture, or a partial vacuum of an inert gas such as argon. As an example, a heat treatment at a temperature of about 2350° F. (about 1290° C.), in argon at less than one atmosphere, and for a duration of about ten hours has been found to be sufficient for nickel-base superalloys.

As a result of the heat treatment, sulfur within the superalloy segregates to the surface of the component 14 and reacts with yttrium, forming oxysulfides such as yttrium oxysulfide (YOS) at the interface between the facecoat 12 and the component 14. Following heat treatment, the component 14 is removed from the mold 10 and core 16, resulting in the sulfides and any elemental sulfur at the surface of the component 14 being simultaneously removed with the facecoat 12 and core 16, as a result of being chemically bonded to the facecoat 12 and core 16. As such, removal of sulfur from the superalloy is through intentionally segregating sulfur to the surface of the component 14, a process contrary to the prior art directed to forming a dispersion of sulfides in the superalloy. By removing the component 14 from the mold 10, sulfides and elemental sulfur are left on the surfaces of the facecoat 12 and core 16 with which the component 14 was cast. Accordingly, further processing or surface treatments of the component 14 are not required for sulfur removal.

In another embodiment of this invention, an yttria powder in a binder is directly applied as a coating (similar in function and appearance to the facecoat 12 and core 16 of FIG. 1) to the surfaces of the component 14 after the component 14 has been removed from the mold 10 and prior to a heat treatment as described above. The coating can be applied as a slurry in a manner similar to that for masking a component prior to coating, such as by spraying or dipping. The binder can be of any suitable type, including an inorganic binder or a lacquer. After coating, the component 14 is heated sufficiently to volatilize the binder and any other volatile constituents within the slurry, leaving an adherent coating of active oxides on the surface of the component 14. As with the facecoat 12 of the first embodiment, a coating thickness of at least about 0.3 millimeter, more preferably at least about one millimeter, ensures a continuous layer is present that can effectively react with and remove any sulfur that subsequently segregates to the surface of the component 14 during the prescribed heat treatment. Following the heat treatment, the coating and the sulfides bonded thereto are removed from the surfaces of the component 14 by a chemical process such as leaching with an acid or base, or a mechanical process such as grit blasting, vapor honing or tumbling.

Notably, the embodiments of this invention can be combined to ensure optimum removal of sulfur from the superalloy component 14. For example, after the component 14 has been removed from the mold 10 equipped with the facecoat 12 and core 16 as depicted in FIG. 1, an yttria slurry can be applied to the surfaces of the component 14. Alternatively, the facecoat 12 and core 16 may be only partially removed from the component 14, which is then further coated with the yttria slurry and then heat treated. With the above additional steps, the ability to adequately remove sulfur from the superalloy is not hindered by the potential for saturating the facecoat 12 and core 16 with sulfides during the in-mold heat treatment.

Following heat treatment and removal of the facecoat 12 or coating, additional heat treatments can be performed on the component 14 as may be desirable or necessary to enhance its mechanical properties, such as by stress relieving or aging at appropriate temperatures and periods for the superalloy.

In a specific example illustrating the processing features of this invention, airfoils were formed from a nickel-base superalloy known as Rene 142, a high strength composition useful in forming directionally solidified castings. Rene 142 is characterized by a nominal composition, in weight percent, of about 12 percent cobalt, about 6.8 percent chromium, about 1.5 percent molybdenum, about 4.9 percent tungsten, about 2.8 percent rhenium, about percent tantalum, about 6.15 percent aluminum, about 1.5 percent hafnium, about 0.12 percent carbon, about 0.015 percent boron, with the balance being essentially nickel and incidental impurities. Notably, yttrium is absent from this particular superalloy composition. The solution temperature of this alloy is approximately 1290° C. (about 2350° F.) and its incipient melting point is estimated to be in the range of about 1204° C. (about 2200° F.) to the solution temperature. Although airfoils formed from Rene 142 were employed to illustrate the features of this invention, the teachings of this invention are generally applicable to any nickel, iron and cobalt-base superalloys that are capable of developing an oxide scale.

Processing of the alloy was entirely conventional, with no special measures taken to exclude sulfur from the melt or to add alloying constituents capable of reacting with sulfur. In accordance with this invention, the melt was poured into a mold characterized by that shown in FIG. 1, in that the surfaces of the mold cavity and mold cores were provided with a facecoat of yttria. Following solidification, some of the airfoils were removed, while others were heat treated within the mold by heating the entire mold assembly to a temperature of about 1290° C. for a duration of about 5.5 hours in a partial vacuum of about $10^{-3}$ Torr. The airfoils were then cooled to room temperature and tested for sulfur content, with results showing the untreated specimens as having a sulfur content of about 10 ppmw while specimens treated in accordance with this invention exhibited a sulfur content of about 1 ppmw.

Figure 2:
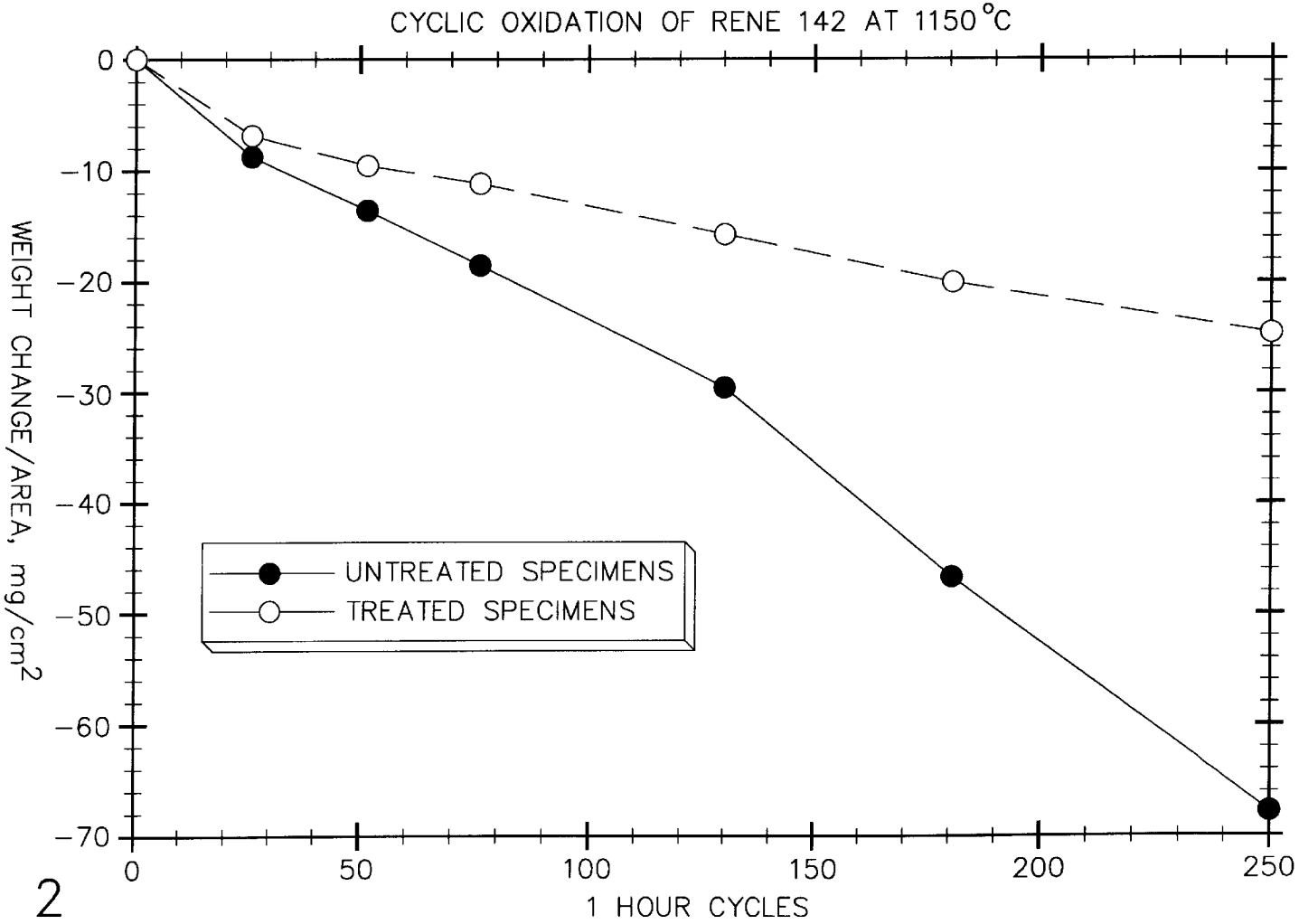
FIG. 2 illustrates the ability of the invention to promote the environmental resistance of a superalloy article through reducing the sulfur content of the article.

Thereafter, all specimens were tested for oxidation resistance by undergoing cyclic oxidation at a temperature of about 1150° C. (about 2100° F.) over a period of 250 hours. Results of this test are represented in FIG. 2, and illustrate the marked ability for the process of this invention to significantly improve the environmental resistance of a nickel-base superalloy.

From the above, it can be appreciated that superalloy components processed in accordance with the method of this invention are characterized by enhanced environmental resistance as a result of sulfur being removed during and/or after casting of the component. Removal of sulfur from a superalloy prevents sulfur segregation at the alloy surface, thereby greatly reducing the tendency for spallation of the desirable oxide scale on the surface of the alloy. Likewise, any thermal barrier coating adhered to the surface of the alloy with the oxide scale will also be less susceptible to spalling as a result of sulfur segregation being prevented. Accordingly, the teachings of this invention are applicable to both coated and uncoated superalloy components.

Additional advantages of the present invention are that long processing times or special fixtures are not required, such that the method is compatible with mass production processes. Furthermore, the mechanical properties of an alloy need not be altered with additions of yttrium or other rare earth metals for the purpose of reacting with sulfur in the bulk alloy. Finally, the advantages of this invention can be achieved using materials that are relatively inexpensive or readily obtained.

While our invention has been described in terms of a preferred embodiment, it is apparent that other forms could be adopted by one skilled in the art, such as by using one or more other stable compounds containing an element that will form a sulfide, oxysulfide or other sulfur compound, and employing the teachings of the invention with other nickel, iron and cobalt-base superalloys. Accordingly, the scope of our invention is to be limited only by the following claims.

What is claimed is:

1. A method for removing sulfur from a superalloy article, the method comprising the steps of:

casting the superalloy article in a mold cavity having in a surface thereof at least one sulfide-forming element present in at least one compound chosen from the group consisting of yttria, calcium oxide, magnesia, scandia, ceria, hafnia, zirconia, titania, lanthana, alumina and silica;

cooling the superalloy article within the mold cavity so that the superalloy article solidifies;

segregating sulfur within the superalloy article to surfaces of the superalloy article by reheating the superalloy article within the mold cavity in a vacuum or nonreactive atmosphere, the sulfide-forming element at the surface of the mold cavity reacting with the sulfur at the surfaces of the superalloy article to form sulfides; and then removing the superalloy article from the mold cavity so as to remove the sulfides and elemental sulfur from the surfaces of the superalloy article.

2. A method as recited in claim 1 wherein the heat treating step is performed at a solution heat treatment temperature of the superalloy article for a duration of up to about ten hours.

3. A method as recited in claim 1 wherein the casting step includes forming a facecoat containing the sulfide-forming element on surfaces of the mold cavity.

4. A method as recited in claim 1 wherein the casting step includes providing a mold core within the mold cavity, the mold core having a surface containing a sulfide-forming element.

5. A method as recited in claim 1 further comprising the steps of depositing a compound containing the sulfide-forming element as a coating on the superalloy article after the superalloy article has been removed from the mold cavity, and then performing a second heat treating step.

6. A method as recited in claim 1 wherein the sulfide-forming element is yttrium.

7. A method as recited in claim 1 wherein the sulfide-forming element is present in a layer having a thickness of at least about 0.3 millimeter.

8. A method as recited in claim 1 further comprising the step of performing a second heat treatment step on the superalloy article following the heat treating step, so as to promote mechanical properties of the superalloy article.

9. A method for improving the environmental resistance of a superalloy article containing sulfur, the method comprising the steps of:

applying to surfaces of a mold cavity a facecoat containing at least one sulfide-forming yttrium compound;

casting the superalloy article in the mold cavity, including cooling the superalloy article so that the superalloy article solidifies;

reheating the superalloy article within the mold cavity for a duration of up to about ten hours in an atmosphere chosen from the group consisting of at least a partial vacuum, a hydrogen-containing gas, and a partial pressure of argon, such that all surfaces of the superalloy article contact the facecoat, the reheating step being performed at a solution heat treatment temperature of the superalloy article so as to cause sulfur within the superalloy article to segregate to the surfaces of the superalloy article and react with the sulfide-forming yttrium compound to form sulfides that adhere to the facecoat; and removing the superalloy article from the mold cavity so as to separate the facecoat from the surfaces of the superalloy article and simultaneously remove the sulfides and elemental sulfur adhering to the facecoat.

10. A method as recited in claim 9 further comprising the step of depositing a compound containing at least one sulfide-forming element as a coating on the superalloy article after the superalloy article has been removed from the mold cavity.

11. A method as recited in claim 9 the casting step includes providing a mold core within the mold cavity, at least surfaces of the mold core being formed of a compound containing at least one sulfide-forming element.

* * * * *